US007231157B2

(12) United States Patent
Kitayama

(10) Patent No.: US 7,231,157 B2
(45) Date of Patent: Jun. 12, 2007

(54) IMAGE FORMING APPARATUS

(75) Inventor: Kunihiko Kitayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/114,181

(22) Filed: Apr. 26, 2005

(65) Prior Publication Data

US 2005/0244178 A1 Nov. 3, 2005

(30) Foreign Application Priority Data

Apr. 28, 2004 (JP) ..... 2004-132962

(51) Int. Cl.
*G03G 15/00* (2006.01)
*G03G 15/16* (2006.01)
*G03G 21/20* (2006.01)

(52) U.S. Cl. ..... 399/49; 399/92; 399/296

(58) Field of Classification Search ..... 399/92, 399/93, 100, 170, 172, 296; 250/324–326; 361/213, 229, 230
See application file for complete search history.

(56) References Cited

U.S. PATENT DOCUMENTS 4,260,235 A * 4/1981 Stack ..... 399/98
5,406,359 A * 4/1995 Fletcher ..... 399/296
6,006,061 A * 12/1999 Liu et al. ..... 399/296
6,006,062 A * 12/1999 Takahashi et al. ..... 399/310
6,545,693 B2 4/2003 Kitayama et al. ..... 347/138
2005/0244178 A1 11/2005 Kitayama ..... 399/49

FOREIGN PATENT DOCUMENTS

JP 1-309082 12/1989
JP 5-289463 11/1993
JP 2000-162852 6/2000

OTHER PUBLICATIONS

JPO Machine Translation (JP Publication 05-289463 A; Nov. 5, 1993).*
JPO Machine Translation (JP Publication 2000-162852 A; Jun. 16, 2000).*

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

The image forming apparatus includes a rotatable image bearing member, a latent image forming device, a developing device, a transferring device, and a corona charging device having a discharge wire and a surrounding shield member and being arranged downstream of a developing position on the image bearing member with respect to its rotational. A density detecting member detects a density of the toner image on the image bearing member at a position downstream of a discharge position of the corona charging device with respect to the rotational direction and upstream of a transfer position. An air flow path is formed through the inside of the shield member and an air is sucked from the image bearing member side toward the shield member. Toner scattered from the developing device side and headed to the density detecting member can be reduced, and ozone near a post charging device can be removed.

5 Claims, 3 Drawing Sheets

IMAGE FORMING APPARATUS

BACKGROUND OF THE INVENTION

1. Field of the Invention

The present invention relates to an image forming apparatus of an electrophotographic system such as a copying machine or a printer which forms an image on a recording material by using the electrophotographic system, or an image forming apparatus of an electrostatic recording system.

2. Description of the Related Art

Today, there are available a greater number of electrophotographic image forming apparatus capable of forming color images. One among them is a color image forming apparatus of a so-called one drum intermediate transferring belt system which sequentially forms toner images of yellow, magenta, cyan and black on one photosensitive drum, sequentially superimposes and transfers the toner images on an intermediate transferring belt, transfers the toner images of the intermediate transferring belt en bloc onto a recording material, and forms color images by fixing unfixed toner images of the recording material thereon by heat. There is also a tandem type color image forming apparatus which arrays a plurality of photosensitive drums, forms toner images of yellow, magenta, cyan, black and the like on the photosensitive drums, transfers the toner images from the photosensitive drums to an intermediate transferring belt, transfers the toner images of the intermediate transferring images onto a recording material, and forms color images by fixing unfixed toner images of the recording material thereon by heat.

In these color image forming apparatus, in a secondary transfer process of transferring the toner images of plural colors formed on the intermediate transferring belt en bloc to the recording material, if a toner charge amount on the intermediate transferring belt varies from color to color, colors of low and high transferabilities are generated, causing a problem of a reduction in image quality.

To prevent the problem, a post charging device for setting toner to a predetermined charge amount on the photosensitive drum after development is disposed to face the photosensitive drum. Toner charge amounts of color toner images transferred to the intermediate transferring belt are made uniform, thereby preventing the aforementioned problem.

Meanwhile, toner density detecting means is disposed in the color image forming apparatus. This toner density detecting means detects a toner density of the toner image on the photosensitive drum, and plays the following two roles.

One of these roles is to detect how much a predetermined latent image is developed, and used for controlling developing efficiency of a developing device. In the case of 2-component development, a mixing ratio of toner and a carrier greatly affects developing efficiency. Thus, feedback is generally given for toner replenishment of the developing device. The other of the above roles is used for controlling a gradation of an output image. A plurality of latent images different in gradation are provided, toner images are formed, densities thereof are detected, and feedback is given for control factors concerning gradation control of a look-up table or the like.

Ordinarily, a toner image for density detection uses an image of a small patch-shaped area. Accordingly, a toner density detecting sensor is called a patch detecting sensor in some case. As it is an optical sensor, the toner density detecting sensor (referred to as "patch detecting sensor", hereinafter) cannot correctly measure a toner density if a sensor surface is stained with toner.

To solve this problem, a proposal of disposing a shutter between a photosensitive drum and a patch detecting sensor is described in Japanese Patent Application Laid-Open No. H01-309082. There is also known a method of preventing sensor staining by disposing a cleaning member such as a brush on a backside of a shutter to collect toner stuck to a sensor surface.

According to the conventional configuration, however, problems described below are inherent. The patch detecting sensor is arranged below the developing device to detect a density of a toner image developed by the developing device. In consequence, the shutter must be opened when the density of the toner image is detected. If development is carried out while the shutter is open, toner scattered from the developing device is stuck to a detecting unit of the patch detecting sensor to stain it.

Thus, Japanese Patent Application Laid-Open No. 05-289463 describes a configuration in which a post charging device is arranged on a downstream side of a developing device with respect to a rotational direction of a photosensitive drum, a patch detecting sensor is arranged on a downstream side of the post charging device, and a transferring unit is arranged on a downstream side of the patch detecting sensor. Such a distance set between the developing device and the patch detecting sensor enables a reduction in staining.

Additionally, an air flow must be formed around the post charging device to remove ozone generated from the post charging device. For the purpose of saving space, Japanese Patent Application Laid-Open No. 2000-162852 describes a configuration in which an air flow for blowing toward a photosensitive drum and a flow of air sucked away from the photosensitive drum (a photosensitive drum side) are formed in a post charging device. With this configuration, ozone generated from the post charging device can be removed.

However, depending on an air flow in the post charging device, toner scattered from the developing device may be headed to the patch detecting sensor, causing a problem of sticking of the scattered toner to the patch detecting sensor even if the developing device and the patch detecting sensor are set apart from each other.

SUMMARY OF THE INVENTION

It is an object of the present invention to reduce toner scattered from a developing means side and headed to a density detecting member, and to remove ozone near post charging means.

It is another object of the present invention to provide an image forming apparatus comprising: a rotatable image bearing member; latent image forming means for forming an electrostatic latent image on the image bearing member; developing means for developing the electrostatic latent image formed on the image bearing member and forming a toner image; transferring means for transferring the toner image of the image bearing member to a transferring material; a corona charging device which has a discharge wire to charge toner of the toner image before transfer and a shield member to surround the discharge wire, and which is arranged in a position on a downstream side of a developing position on the image bearing member with respect to a rotational direction of the image bearing member; a density detecting member which detects a density of the toner image on the image bearing member in a position on a downstream side of a discharge position of the corona discharging device with respect to the rotational direction of the image bearing member and on an upstream side of a transfer position; and an air flow path in which an air flow path formed through an inside of the shield member to pass air sucked from an image bearing member side toward the inside of the shield member.

Further objects of the invention will become apparent upon reading of the following description.

DETAILED DESCRIPTION OF THE PREFERRED EMBODIMENTS

First Embodiment

Figure 1:
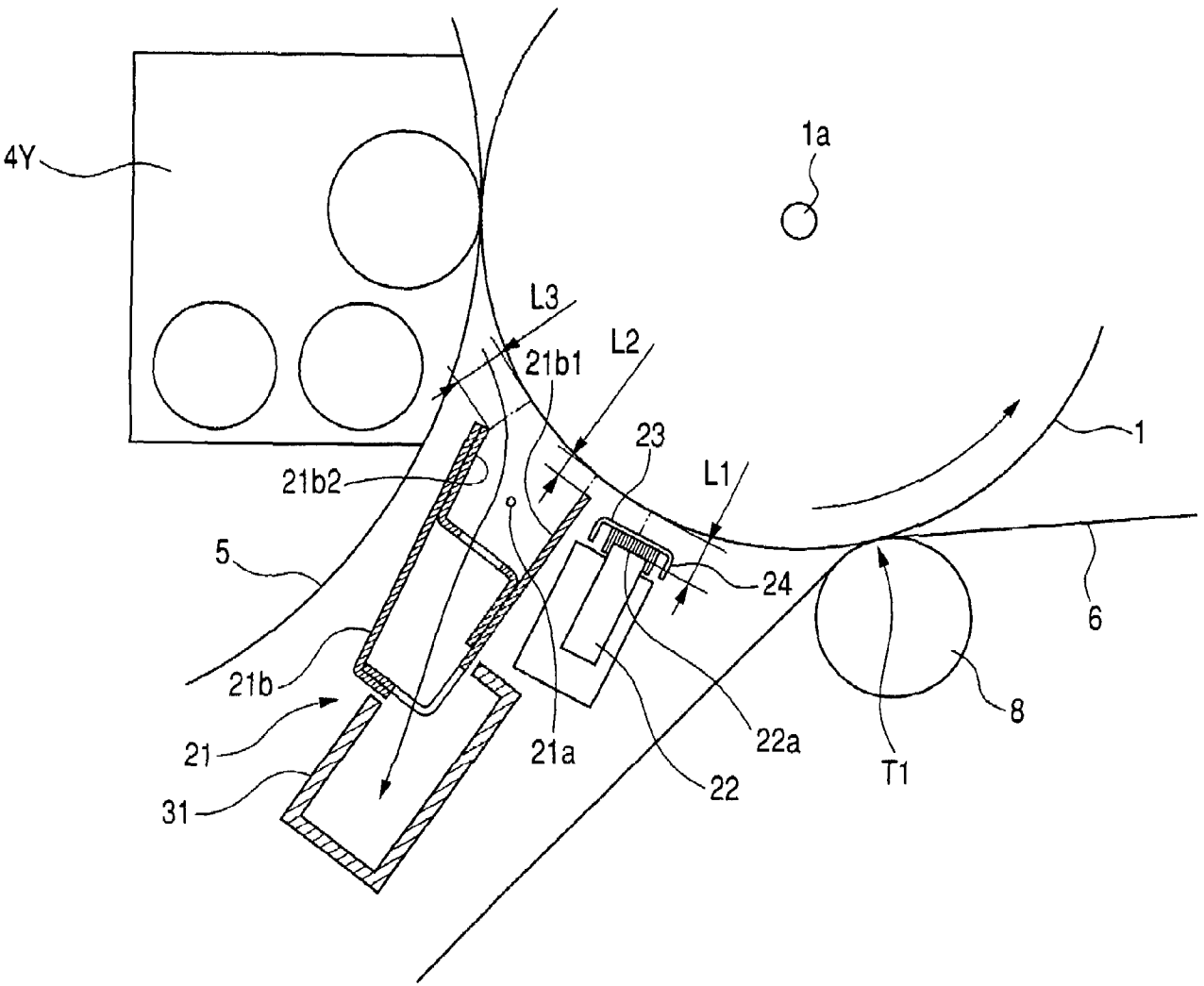
FIG. 1 is an explanatory diagram showing an arrangement of post charging means and toner density detecting means.
Figure 2:
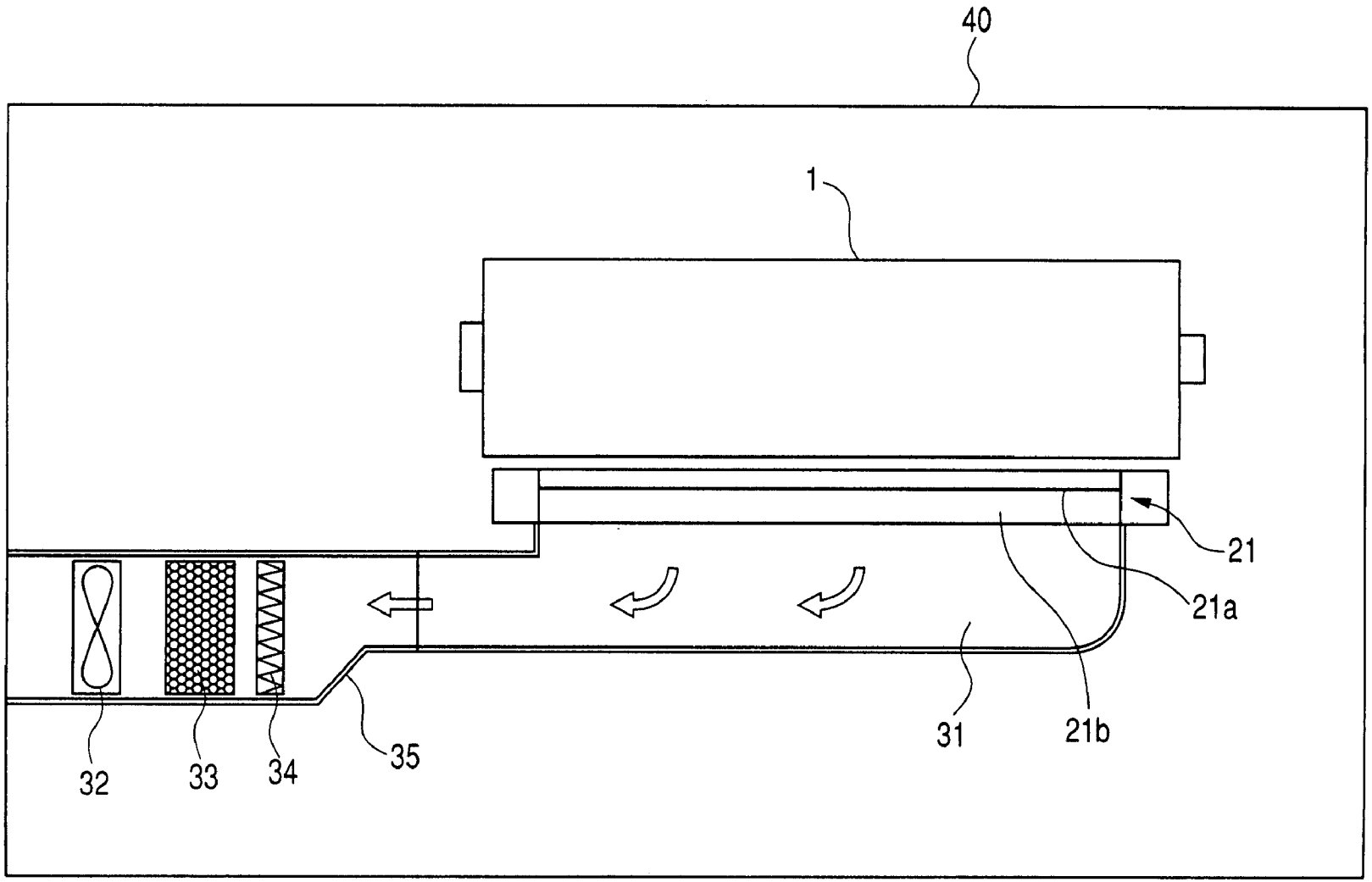
FIG. 2 is an explanatory diagram showing an air flow path of the post charging means.
Figure 3:
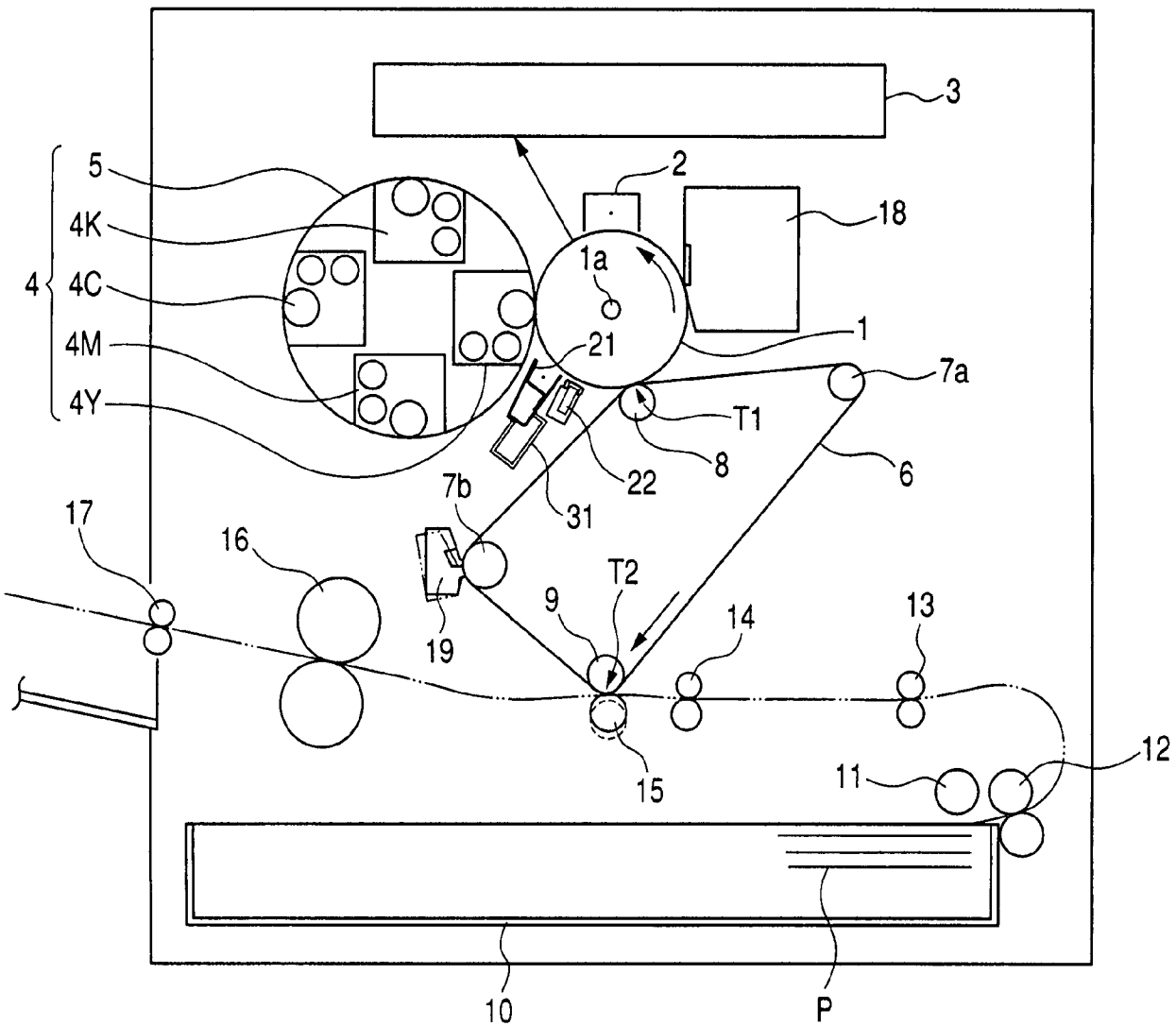
FIG. 3 is a sectional explanatory diagram showing an image forming apparatus.

Next, referring to FIGS. 1 to 3, an image forming apparatus according to an embodiment of the present invention will be described. FIG. 1 is an explanatory diagram showing an arrangement of a post charging device and a density detecting member, FIG. 2 is an explanatory diagram showing an air flow path heading from the post charging device to the outside of the image forming apparatus, and FIG. 3 is a sectional explanatory diagram of the image forming apparatus.

(Entire Configuration of Image Forming Apparatus)

First, referring to FIG. 3, an entire configuration of the image forming apparatus according to the first embodiment will be described. The image forming apparatus of the embodiment is shown in a sectional diagram of a color image forming apparatus of a one drum intermediate transferring belt system.

A photosensitive drum 1 that is an image bearing member is rotatably disposed, a primary charging device 2 is arranged as charging means for charging the image bearing member, and a surface of the photosensitive drum is uniformly charged. A laser unit 3 that is writing means selectively exposes the surface of the photosensitive drum 1 in accordance with an image signal, and an electrostatic latent image is formed.

A developing device 4 that is developing means visualizes the electrostatic image by toner. The developing device 4 comprises developing devices 4Y, 4M, 4C and 4K as four developing means having toner of yellow (Y), magenta (M), cyan (C) and black (K). These developing devices 4Y, 4M, 4C and 4K are mounted on a rotary 5 which can be rotated. The rotary 5 is rotated in accordance with image formation, the developing devices sequentially face the photosensitive drum 1, and toner images of respective colors are developed.

Below the photosensitive drum 1, an intermediate transferring belt 6 that is an intermediate transferring member is rotatably disposed by being hung on a driving roller 7*a*, a follower roller 7*b*, a primary transfer roller 8, and a secondary transfer inner roller 9. The toner images of the photosensitive drum visualized by the developing devices 4Y, 4M, 4C and 4K of respective colors are sequentially transferred to the intermediate transferring belt as a transferring material at a primary transfer unit T1 by applying a bias to the primary transfer roller 8 as a transferring member, whereby multiple-transferred toner images are obtained on a surface of the intermediate transferring belt 6.

A recording material P is fed from a feed cassette 10 to a feed roller 11, a separation roller pair 12, a conveying roller pair 13, and a registration roller pair 14 which constitute conveying means. Then, the recording material P waiting at the registration roller pair 14 is sent to a secondary transfer unit T2 in synchronization with the toner images on the intermediate transferring belt 6.

A secondary transfer roller 15 that is secondary transferring means is configured to be freely brought into contact with/separated from the intermediate transferring belt 6. The secondary transfer roller 15 moves apart from the intermediate transferring member 6 while a multiple transferring process is carried out thereon, and abuts on the same when a secondary transfer process is carried out. Then, the toner images on the intermediate transferring belt 6 are transferred onto the recording material P at the secondary transfer unit T2 by applying a bias to the secondary transfer roller 15.

Subsequently, the toner images borne on the recording material are fixed on the recording material P by heat and pressure at a fixing device 16. The recording material is discharged to a discharge unit by a discharge roller pair 17.

On the other hand, the photosensitive drum 1 comprises a drum cleaner 18, and the intermediate transferring belt 6 comprises a transfer cleaner 19. These are both blade cleaning types. The drum cleaner 18 cleans untransferred toner left on the photosensitive drum in the primary transfer process. The transfer cleaner 19 is configured to be freely brought into contact with/separated from the intermediate transferring belt 6, and cleans untransferred toner left on the intermediate transferring belt 6 in the secondary transfer process.

In the image forming apparatus of the embodiment, a post charging device 21 that is post charging means is arranged on a rotational-direction downstream side of the photosensitive drum with respect to the developing device 4, and a patch detecting sensor 22 that is a density detecting member is arranged on a further rotational-direction downstream side of the photosensitive drum.

(Post Charging Device and Toner Density Detection)

Next, referring to FIGS. 1 and 2, the post charging device 21 and the patch detecting sensor 22 will be described. As shown in FIG. 1, the post charging device 21 is arranged on the downstream side of the developing device 4. This post charging device 21 controls a toner charge amount of a toner image on the photosensitive drum 1.

For example, toner materials may be different between color toner of yellow, magenta and cyan and black toner, and toner charge amounts may be different. In such a case, only when a black toner image is developed on the photosensitive drum 1, a high voltage is applied by the post charging device 21 arranged on its downstream side, and a black toner charge amount is controlled, whereby the black toner charge amount can be made equal to the color toner charge amount. Accordingly, toner transfer is uniformly carried out in the secondary transfer process for transferring the toner image to the recording material, thereby preventing defective images.

As shown in FIG. 1, the post charging device 21 is a corona charging device which includes a metal shield member 21*b* disposed to surround three sides of a charging line 21*a* and having an opening in a portion opposed to the photosensitive drum 1.

The patch detecting sensor 22 that becomes toner density detecting means for detecting a density of the toner image formed on the photosensitive drum 1 is arranged on a downstream side of the post charging device 21 but on an upstream side of the primary transfer unit T1 with respect to a rotational direction of the photosensitive drum 1. This patch detecting sensor 22 detects a toner density of the toner image on the photosensitive drum 1, and it is used for controlling toner replenishment of the developing device 4 and a gradation of an output image.

As it is an optical sensor, the patch detecting sensor 22 cannot correctly measure a toner density if a sensor surface 22*a* opposed to the photosensitive drum 1 is stained with toner. Thus, a shutter 23 that can open/close the sensor surface 22*a* is disposed to prevent sensor staining, and the sensor surface 22*a* is closed by the shutter 23 as much as possible when unnecessary. Moreover, a brush 24 is disposed as a cleaning member on the backside of the shutter 23. The sensor surface 22*a* is cleaned by collecting toner.

However, as there is a limit to its toner collecting efficiency, the brush 24 is set as a replaceable component. When a great amount of scattered toner comes to the sensor surface 22*a*, a brush replacing period must be set short, resulting in burdensome work. Especially, if the sensor surface 22*a* is located below a rotational center la of the photosensitive drum 1 in a vertical direction as in the case of the image forming apparatus of the embodiment, scattered and dropped toner is easily stuck thereto.

Thus, while the aforementioned stain preventing mechanism is important, it is important to prevent scattered toner from coming to the sensor surface 22*a*. Accordingly, in the apparatus of the embodiment, an air flow path is disposed in the post charging device 21 as described below.

(Air Flow of Post Charging Device)

As shown in FIGS. 1 and 2, in the image forming apparatus of the embodiment, an air duct 31 is disposed below the post charging device 21. A path indicated by an arrow in FIG. 1 represents an air flow path of the post charging device 21. Since the air duct 31 is thus disposed, air can be sucked from the opening of the shield member 21*b* of the post charging device 21 through the inside thereof into the air duct 31.

As shown in FIG. 2, an air duct 35 that is fluidly communicated with the air duct 31 of the post charging device 21 is disposed in an apparatus main body 40 of the image forming apparatus. An ozone filter 33 and a toner filter 34 are disposed together with an exhaust fan 32 in the air duct 35. By driving of the exhaust fan 32, air around the post charging device 21 is passed through the inside of the shield, through the air ducts 31 and 35, and exhausted through the ozone and toner filters 33 and 34 to the outside of a machine. According to the embodiment, an axial-flow fan of 60 mm in longitudinal and horizontal width is used for the exhaust fan. An air volume of the fan is 0.5 to 0.9 $m^3$/min. when 24 V is applied to the fan (full speed), and 0.3 to 0.5 $m^3$/min. when 12 V is applied to the fan (half speed). The fan is not limited to this fan. Effects similar to those of the invention can be obtained even by an axial-flow fan of a different size or a fan of a different shape.

Thus, ozone generated by corona discharging of the post charging device 21, and scattered toner generated near the developing device 4 are discharged from the opening disposed in the shield member 21*b* through the air flow path, and collected through the ozone and toner filters 33 and 34. The opening is preferably disposed in an entire longitudinal area of the post charging device 21.

As described above, the air is sucked toward the inside of shield member at the portion of the post charging device 21 located on an upstream side of the patch detecting sensor 22 with respect to the rotational direction of the photosensitive drum, thereby collecting the scattered toner. Thus, the amount of scattered toner near the patch detecting sensor 22 becomes small, whereby toner staining of the sensor surface 22*a* is greatly reduced.

Furthermore, no new air flow is added to collect the scattered toner. Thus, ozone discharging performance from the post charging device 21 can be secured without improving exhaust fan performance (air volume, pressure).

Now, the image forming apparatus of the embodiment is configured as follows to efficiently collect the scattered toner.

As shown in FIG. 1, a proximate distance L1 between the sensor surface 22*a* of the patch detecting sensor 22 and the surface of the photosensitive drum 1 is set larger than a proximate distance L2 between a photosensitive drum side end of a shield plate 21*b*1 on a downstream side of the adjacent post charging device 21 with respect to the rotational direction of the photosensitive drum and the surface of the photosensitive drum 1 (L2<L1). In other words, a tip of the shield plate 21*b*1 on the downstream side of the post charging device 21 is nearer the photosensitive drum 1 than the sensor surface 22*a* of the patch detecting sensor 22.

Accordingly, since the shield plate 21*b*1 becomes a shield when seen from the patch detecting sensor 22, scattered toner reaching the sensor surface 22*a* of the patch detecting sensor 22 becomes difficult, thereby increasing the stain preventing effect of the sensor surface 22*a*.

Additionally, a proximate distance L3 between a photosensitive drum side end of a shield plate 21*b*2 on the upstream side of the post charging device 21 and the surface of the photosensitive drum 1 is set larger than the proximate distance L2 between the photosensitive drum side end of the shield plate 21*b*1 on the downstream side and the surface of the photosensitive drum 1 (L2<L3). Accordingly, an air flow amount sucked from the upstream side of the opening formed in the shield member 21*b* of the post charging device 21 with respect to the rotational direction of the photosensitive drum becomes larger than an air flow amount sucked from the downstream side of the opening, whereby toner scattered around the developing device 4 can be more effectively collected.

Thus, according to the image forming apparatus of the embodiment, toner staining prevention of the patch detecting sensor 22 as the density detecting member and ozone discharge performance securing from the post charging device 21 can both be realized, and it is possible to maintain a good image forming operation for a long time.

Furthermore, according to the image forming apparatus of the one drum intermediate transferring belt system, even if the patch detecting sensor 22 is arranged below the photosensitive drum 1 and in a position which causes easy sticking of scattered toner to the sensor surface 22*a* because of a member arrangement, it is possible to realize both toner staining prevention of the sensor surface 22*a* and ozone discharge performance.

(Fan Driving)

A fan operation sequence of sucking air from the photosensitive drum side into the shield of the post charging device will be described. According to the embodiment, for the fan operation, two types of operations are enabled: a full-speed state in which 24 V is applied to the fan, and a half-speed state in which 12 V half of that of the full-speed state is applied to the fan. According to the embodiment, during an image forming operation, the fan is rotated in the full-speed state because the amount of toner scattered from the developing device is large. A period of the image forming operation is from an input of an image forming operation signal to an end of the image forming operation or a passage of predetermined time after the end. In a state in which power is ON and a process waits for an input of an image forming operation signal (standby state), the fan is rotated in the half-speed state because the amount of toner scattered from the developing device is small.

Other Embodiments

The embodiment has been described by way of the image forming apparatus of the one drum intermediate transferring belt system. However, the configuration of using the intermediate transferring belt does not need to be always used. For example, even in the case of an image forming apparatus configured to enable circulation and conveyance of a recording material with respect to a photosensitive drum and to sequentially form toner images of respective colors on a photosensitive drum, and obtain color images by sequentially superimposing and transferring the toner images on a circulating recording material, effects similar to those of the embodiment can be obtained by arranging the post charging device 21 having the aforementioned air flow path and the patch detecting sensor 22.

Thus, according to the present invention, by sucking air toward the air flow path disposed in the post charging device located on the upstream side of the density detecting member, discharging of ozone from the post charging means and collection of scattered toner are simultaneously carried out, and toner staining of the toner density detecting means located on the downstream side thereof can be suppressed.

Furthermore, no new air flow path needs to be added to collect the scattered toner. Thus, it is possible to secure ozone discharge performance from the post charging means without improving exhaust fan performance.

The embodiment of the present invention has been described. However, the embodiment is in no way limitative of the invention, and various changes and modifications can be made within technical ideas of the invention.

This application claims priority from Japanese Patent Application No. 2004-132962 filed Apr. 28, 2004, which is hereby incorporated by reference herein.

What is claimed is:

1. An image forming apparatus comprising:

an image bearing member which is rotatable;

latent image forming means which forms an electrostatic latent image on said image bearing member;

developing means which develops the electrostatic latent image formed on said image bearing member and forms a toner image;

transferring means which transfers the toner image on said image bearing member to a transferring material;

a corona charging device which has a discharge wire to charge toner of the toner image before transfer and a shield member which opposes and surrounds the discharge wire, said corona charging device being arranged at a position on a downstream side of a developing position on said image bearing member with respect to a rotational direction of said image bearing member;

a fan which sucks air from a side of said image bearing member to form an air flow path through an inside of the shield member; and a density detecting member, which detects a density of the toner image on said image bearing member, said density detecting member being provided proximate to said corona charging device and on a downstream side of said corona charging device with respect to the rotational direction of said image bearing member, and on an upstream side of said transferring means, wherein a distance between an end part of said shield member on a side closer to said development means and a surface of said image bearing member is greater than a distance between an end part of said shield member on a side closer to said density detecting member and the surface of said image bearing member.

2. An apparatus according to claim 1, wherein a distance between a detecting surface of said density detecting member and the surface of said image bearing member is greater than the distance between the end part of said shield member on the side closer to said density detecting member and the surface of said image bearing member.

3. An apparatus according to claim 1, wherein said fan is controlled so that an air flow speed at an image forming time is higher than an air flow speed at a stand-by time.

4. An apparatus according to claim 1, wherein the air flow path is fluidly communicated with another air flow path which guides air to an outside of said image forming apparatus.

5. An apparatus according to claim 1, further comprising an intermediate transferring member which transfers a toner image formed on the image bearing member, wherein said corona charging device and said density detecting member are provided in a space between said developing means and said intermediate transferring member.

* * * * *

UNITED STATES PATENT AND TRADEMARK OFFICE

CERTIFICATE OF CORRECTION

PATENT NO. : 7,231,157 B2
APPLICATION NO. : 11/114181
DATED : June 12, 2007
INVENTOR(S) : Kunihiko Kitayama It is certified that error appears in the above-identified patent and that said Letters Patent is hereby corrected as shown below:

TITLE PAGE:
At Item (57), Abstract, line 7, "rotational." should read --rotational direction.--.
At Item (57), Abstract, line 12, "an air" should read --air--.

COLUMN 4:
Line 34, "rotational-direction" should read --rotational direction--.
Line 37, "rotational-direction" should read --rotational direction--.
Line 47, "toner" should read --toners--; and "magenta and" should read --magenta,--.

COLUMN 5:
Line 20, "1a" should be boldface.
Line 64, "shield" should read --the shield--.

COLUMN 6:
Line 28, "a shield plate **21*b*2" should read --the shield plate 21*b*2**--.

Signed and Sealed this

Twentieth Day of May, 2008

JON W. DUDAS
*Director of the United States Patent and Trademark Office*